US005292627A

United States Patent [19]

Hershey et al.

[11] Patent Number: 5,292,627

[45] Date of Patent: Mar. 8, 1994

[54] TONE CONTROL OF PHOTOGRAPHIC IMAGES

[75] Inventors: Stephen A. Hershey, Fairport; J. Ramon Vargas, Webster; Paul A. Burns, Rochester, all of N.Y.

[73] Assignee: Eastman Kodak Company, Rochester, N.Y.

[21] Appl. No.: 892,850

[22] Filed: Jun. 3, 1992

[51] Int. Cl.[5] ..... G03C 5/00

[52] U.S. Cl. ..... 430/356; 430/402; 430/565; 430/567; 430/568; 430/611; 430/614; 430/615

[58] Field of Search ..... 430/233, 356, 402, 565, 430/567, 611, 614, 615, 568

[56] References Cited

U.S. PATENT DOCUMENTS

| | | | |
|---|---|---|---|
| 4,720,447 | 1/1988 | De Keyzer et al. | 430/244 |
| 4,727,017 | 2/1988 | Pollet et al. | 430/611 |
| 4,728,601 | 3/1988 | Rowland et al. | 430/565 |
| 4,859,565 | 8/1989 | De Keyzer et al. | 430/231 |

FOREIGN PATENT DOCUMENTS

| | | | |
|---|---|---|---|
| 63-246739 | 10/1988 | Japan | 430/611 |

OTHER PUBLICATIONS

James, T. H. ed. The Theory of the Photographic Process, 4th Edition, 1977, p. 100.

*Primary Examiner*—Janet C. Baxter

*Attorney, Agent, or Firm*—Carl O. Thomas

[57] ABSTRACT

Monocyclic and polycyclic azoles having the following formula modify the tone of a silver image formed from a fine grain radiation sensitive silver bromide or silver bromoiodide emulsion layer in which the silver bromide or silver bromoiodide grains have a mean equivalent circular diameter of less than 0.3 μm. The azoles have the formula:

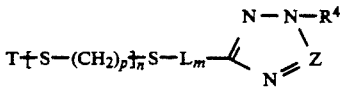

(I)

wherein

Z is —N= or —C($R^5$)= where $R^5$ is hydrogen, —$NH_2$, aliphatic of 1 to 8 carbon atoms or aromatic of 1 to 8 carbon atoms;

$R^4$ is hydrogen, aliphatic of 1 to 8 carbon atoms or aromatic of 1 to 8 carbon atoms;

$R^4$ and $R^5$ together complete a 5 or 6 membered heterocyclic nucleus containing 1 to 3 ring nitrogen atoms;

L is a divalent aliphatic linking group containing 1 to 8 carbon atoms;

T is an aliphatic terminal group containing 1 to 10 carbon atoms;

m is 0 or 1;

n is an integer of 1 to 4; and p is an integer of 2 to 4.

20 Claims, No Drawings

TONE CONTROL OF PHOTOGRAPHIC IMAGES

FIELD OF THE INVENTION

This invention relates to modifying the tone of photographic silver images formed from radiation sensitive silver bromide or silver bromoiodide emulsions. More particularly, the invention relates to a silver image forming photographic element that has an emulsion layer containing radiation sensitive silver bromide or silver bromoiodide fine grains and contains an azole which is effective to modify the tone of the silver image formed upon development of such grains in the presence of the azole.

BACKGROUND

To attain an accurate patient diagnosis, a medical radiologist typically relies upon a visual study of silver images in photographic elements. Image study usually occurs with the element mounted on a light box, a white translucent illumination source. Silver halide photographic elements can be exposed to X-radiation alone to produce viewable silver images. A more efficient approach, which greatly reduces X-radiation exposures, is to employ an intensifying screen in combination with the radiographic element. The intensifying screen absorbs X-radiation and emits longer wavelength electromagnetic radiation which silver halide emulsions more readily absorb. Another technique for reducing patient exposure is to coat two silver halide emulsion layers on opposite sides of the film support to form a "double coated" radiographic element. Diagnostic needs can be satisfied at the lowest patient X-radiation exposure levels by employing a double coated radiographic element in combination with a pair of intensifying screens. However, alternatives are now available to the radiologist for capturing the X-radiation image. For example, the X-radiation image can be captured in a storage phosphor screen. By subsequently scanning the exposed storage phosphor screen with stimulating radiation, an emission profile can be read out and sent to a computer where it is stored. Such an imaging approach is described in Luckey U.S. Pat. No. Re. 31,847 and DeBoer et al. U.S. Pat. No. 4,733,090.

To provide the radiologist with a viewable image that can be studied, the stored image information can be used as recorded or with computer enhancement, to expose a diagnostic photographic film, often using a modulated light emitting diode or He-Ne laser source emitting in the red or near infrared region of the electromagnetic spectrum as the exposure source. After exposure, the diagnostic photographic film is photographically developed to provide a silver image for examination. In a typical procedure, such a diagnostic photographic film is run through a processing cycle, usually a so-called rapid-access process in which processing is completed in 90 seconds or less, which is the same as the processing cycle used for processing diagnostic photographic film that is directly exposed to X-radiation. The same rapid-access process is used by the radiologist for efficiency of effort. Also, such rapid-access processing is capable of providing comparable viewable silver images in diagnostic photographic films when such images are provided by direct exposure to X-radiation or by alternative exposure techniques such as where the image is provided by scanning a storage phosphor screen. Furthermore, since a patient being examined cannot be released until successful recording of the silver images needed for diagnosis has been confirmed, the diagnostic photographic films are normally constructed to provide rapid-access processing.

A photographic element that can be used as a diagnostic film without direct exposure to X-radiation in the manner described hereinbefore, frequently comprises at least one emulsion layer containing radiation sensitive silver bromide or silver bromoiodide fine grains. Such elements have good speed and provide silver images exhibiting excellent definition of the type required for examination by a radiologist. Unfortunately, such silver images can exhibit a warm tone, for example, a yellowish, greenish or brown hue when the elements are viewed by transmitted light. For a skilled diagnostician, such warm tone images are an obstacle to accurate diagnosis. A neutrally black or colder tone image is desired.

U.S. Pat. No. 4,728,601 describes the use of certain 2-alkylthio-4-hydroxy-1,3,3a,7-tetraazaindenes to modify silver image tone in a photographic element and impart a neutral tone to a developed silver image formed upon exposure and processing of the element. Such image toning materials comprise a single sulfur atom in an alkylthio substituent and have the following formula:

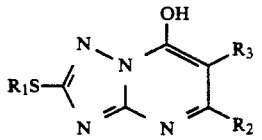

wherein $R_1$ is alkyl containing 6 to 11 carbon atoms or is a ring system and the groups $R_2$ and $R_3$ are each individually hydrogen or alkyl containing 1 to 4 carbon atoms.

The above azole compounds are shown to be useful in an element comprising a gelatin fine grain silver chlorobromide emulsion containing 55 mole percent silver chloride and 45 mole percent silver bromide. U.S. Pat. No. 4,728,601 also alleges that such compounds are useful toning materials in photographic silver halide emulsions of any halide composition, but no data is presented in support of this allegation. Furthermore, it has been our experience, as demonstrated by Examples that follow, that monothiaalkyl substituted compounds of the type described in U.S. Pat. No. 4,728,601 are not effective for modifying the tone of a silver image formed from fine grain radiation sensitive silver bromide or silver bromoiodide emulsions.

U.S. Pat. Nos. 4,720,447 and 4,859,565 may, upon superficial examination, appear to be of some interest with respect to the present invention since these patents describe the use of heterocyclic azole compounds as density- and/or tone controlling compounds. However, these patents simply describe the use of such compounds in a photographic silver complex diffusion transfer reversal process (often simply referred to as a DTR process) wherein a silver image is formed in a non-radiation sensitive layer from a soluble silver salt. There is no suggestion that such compounds would have any effect in modifying the tone of a silver image formed from a fine grain radiation sensitive silver bromide or silver bromoiodide emulsion of the type used in the present invention. Furthermore, as demonstrated in the following Examples, U.S. Pat. Nos. 4,720,447 and 4,859,565 describe the use of a broad class of heterocyclic azole compounds that include many compounds that are taught to be effective for patentees' purposes, but would not be useful in the practice of this invention. For example, a large number of the heterocyclic azole compounds described in the aforementioned patents do not contain multiple sulfur atoms in an aliphatic substituent on an azole ring which is an essential feature of this invention. It is significant to note that for patentees' purposes, no distinction is made between heterocyclic azoles which contain no thiaalkyl substituents, those that contain only a single sulfur atom in a thiaalkyl substituent and those that contain multiple sulfur atoms in a thiaalkyl substituent. Accordingly, it is evident that U.S. Pat. Nos. 4,720,447 and 4,859,565 are not pertinent to the present invention which pertains to the use of a specific class of heterocyclic azoles to modify the tone of a silver image formed from a photographic element comprising an emulsion layer containing fine grains of radiation sensitive silver bromide or silver bromoiodide.

In the previous description, emphasis has been placed on the advantages of modifying the tone of a silver image formed from a diagnostic photographic film. However, it is well known in the art that photographic elements used for other purposes, e.g. in the field of graphic arts, can also benefit from such tone modification. Accordingly, this invention is specifically contemplated for use with such elements, as will be described in greater detail hereinafter.

In light of the previous discussion, it is obvious that it would be very desirable to have a photographic element, particularly one useful as a diagnostic photographic film, which would provide high definition silver images having a satisfactory tone. Likewise, it would be desirable to have such a photographic element with the capability of being processed using black and white processing procedures, especially conventional rapid-access X-ray processing techniques. This invention provides such a photographic element and a means for obtaining a neutral tone high definition silver image.

RELATED CONCURRENTLY FILED U.S. PATENT APPLICATIONS

U.S. patent application Ser. No. 07/892,851, filed Jun. 3, 1992, entitled "Tone Control of Photographic Silver Images", S. A. Hershey, J. R. Vargas and Paul A. Burns, pertains to the use of monocyclic and polycyclic azoles having an aliphatic substituent containing multiple sulfur atoms to modify the tone of a silver image formed from a fine grain radiation sensitive silver chlorobromide emulsion layer in which the silver chlorobromide grains contain up to 70 mole percent chloride and have a mean equivalent circular diameter of less than 0.3 μm.

U.S. patent application Ser. No. 07/892,851, filed Jun. 3, 1992, entitled "Radiographic Elements with Improved Covering Power", S. A. Hershey, J. R. Vargas and Paul A. Burns, pertains to the use of monocyclic and polycyclic azoles having an aliphatic substituent containing at least one sulfur atom to enhance the covering power of a developed silver image formed from a radiographic element comprising a radiation sensitive tabular grain silver bromide, silver bromochloride or silver bromoiodide emulsion layer containing grains having a mean equivalent circular diameter of at least 0.3 μm and a tabularity of greater than 8, determined by the relationship $$T = \frac{ECD}{t^2},$$

where T is tabularity, ECD is the mean effective circular diameter in μm of the tabular grains, and t is the mean thickness in μm of the tabular grains.

SUMMARY OF THE INVENTION

In accordance with this invention, a certain class of azoles, as described hereinafter, is used to modify the tone of a silver image formed from a fine grain radiation sensitive silver bromide or silver bromoiodide emulsion. Thus, this invention provides a silver image forming photographic element comprising a support having thereon an emulsion layer containing radiation sensitive silver bromide or silver bromoiodide fine grains having a mean equivalent circular diameter of less than 0.3 μm. Such element contains an azole that is present in a concentration effective to modify the tone of the developed silver image and has the formula:

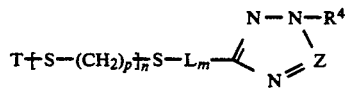

(I)

wherein Z is —N= or —C($R^5$)= where $R^5$ is hydrogen, —$NH_2$, aliphatic of 1 to 8 carbon atoms or aromatic of 1 to 8 carbon atoms; $R^4$ is hydrogen, aliphatic of 1 to 8 carbon atoms or aromatic of 1 to 8 carbon atoms; $R^4$ and $R^5$ together complete a 5 or 6 membered heterocyclic nucleus containing 1 to 3 ring nitrogen atoms; L is a divalent aliphatic linking group containing 1 to 8 carbon atoms; T is an aliphatic terminal group containing 1 to 10 carbon atoms; m is 0 or 1; n is an integer of 1 to 4; and p is an integer of 2 to 4.

In practicing the invention, modification of the silver image is achieved simply by developing the silver bromide or silver bromoiodide emulsion layer in the presence of the aforementioned azole. Such processing can be accomplished using conventional rapid-access X-ray processing techniques or by other conventional black and white processing.

An additional feature of interest in this invention is demonstrated by the following Example 1. As illustrated by Example 1, a photographic element of this invention that comprises an emulsion layer containing fine radiation sensitive silver bromide or silver bromoiodide grains, especially grains having an ECD of less than 0.1 μm, and certain of the azoles described herein, provides a silver image exhibiting increased optical density per unit of developed silver, i.e. increased covering power, as well as improved image tone.

DETAILED DESCRIPTION OF THE INVENTION

The radiation sensitive silver bromide or silver bromoiodide emulsions employed in the practice of this invention are fine grain emulsions. The fine grains provide high definition images and excellent speed and have a mean equivalent circular diameter of less than 0.3 μm, often about 0.04 to 0.25 and preferably about 0.04 to 0.22 μm. The term "equivalent circular diameter" (sometimes referred to herein simply as ECD) is used in its art recognized sense to indicate the diameter of a circle having an area equal to that of the projected area of a grain. Suitable grains can vary in shape and include conventional grain shapes known to those in the art such as cubic and octahedral grains, provided such grains have the desired mean equivalent circular diameter. The silver halide emulsions that form the emulsion layers in photographic elements of this invention have a significant bromide content which can be as high as 100 mole percent, based on total silver, as in the case of the silver bromide emulsions, although the bromide content can be less, as in the case of the silver bromoiodide emulsions. In the latter case, the iodide content is typically less than 15 mole percent, based on total silver, often about 2 to 10 mole percent, although higher mole percentages of iodide can be useful in some situations.

The class of azoles used in the practice of this invention comprise azoles containing a heterocyclic nitrogen containing ring having thereon a thiaalkylene moiety that contains two or more sulfur atoms which replace carbon in an alkylene chain. Such compounds are effective to modify the tone of the silver image upon development without any significant deleterious effect on the sensitivity of the silver bromide or silver bromoiodide emulsion layers containing such compounds. Suitable azoles of this type are monocyclic and polycyclic azoles such as triazoles, tetrazoles and substituted 1,3,3a,7-tetraazaindenes. As previously indicated herein, azoles useful in the practice of this invention can be represented by the following formula:

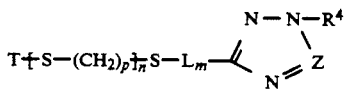

(I)

wherein Z is —N= or —C($R^5$)= where $R^5$ is hydrogen, —$NH_2$, aliphatic of 1 to 8 carbon atoms or aromatic of 1 to 8 carbon atoms; $R^4$ is hydrogen, aliphatic of 1 to 8 carbon atoms or aromatic of 1 to 8 carbon atoms; $R^4$ and $R^5$ together complete a 5 or 6 membered heterocyclic nucleus containing 1 to 3 ring nitrogen atoms; L is a divalent aliphatic linking group containing 1 to 8 carbon atoms; T is an aliphatic terminal group containing 1 to 10 carbon atoms; m is 0 or 1; n is an integer of 1 to 4; and p is an integer of 2 to 4.

Some illustrative $R^4$ and $R^5$ radicals of formula (I) that contain 1 to 8 carbon atoms, typically hydrocarbon and often containing 1 to 4 carbon atoms, include alkyl radicals such as methyl, ethyl, propyl, isopropyl, butyl, t-butyl and octyl; cycloalkyl radicals such as cyclopropyl, cyclobutyl, cyclopentyl and cyclohexyl; aralkyl radicals such as benzyl and phenethyl; aryl radicals such as phenyl and methylphenyl; fluoroalkyl such as fluoroethyl, dialkylaminoalkyl containing the same or different alkyls such as dimethylaminoethyl or diethylaminoethyl and acyclic radicals in which a carbon chain is interrupted by a hetero atom such as oxygen and/or sulfur, for example, at least one —O— or —S— atom interrupts a carbon chain. As indicated in the formula (I), $R^4$ and $R^5$ can be joined to complete a 5 or 6 membered heterocyclic nucleus containing 1 to 3 ring nitrogen atoms. Such nucleus is often a 6 membered heterocyclic nucleus containing 2 ring nitrogen atoms. Examples of suitable nuclei include a thiazole nucleus (for example, thiazole, 4-methylthiazole), an oxazole nucleus (for example, oxazole, 4-phenyloxazole), an isoxazole nucleus (for example, 5-methylisoxazole), a pyridine nucleus (for example, 2-pyridine,3-methyl-4-pyridine), a pyrimidine nucleus (for example, a 2-methyl-4-hydroxy pyrimidine), a pyrazine nucleus, a thiadiazole nucleus, a tetrazole nucleus, a triazine nucleus, a 1,2,4-triazole nucleus or a pyrazole nucleus. Such nuclei may be substituted on the ring by one or more of a wide variety of substituents but such substituents generally have only a limited effect on toning. Examples of such substituents are hydroxy, halogen (for example, fluorine, chlorine, bromine, iodine), alkyl (for example, methyl, ethyl, propyl, butyl, pentyl, octyl), aryl (for example, phenyl, 1-naphthyl, 2-naphthyl), aralkyl (for example, benzyl, phenethyl), alkoxy (for example, methoxy, ethoxy), aryloxy (for example, phenoxy and 1-naphthyloxy), alkylthio (for example, methylthio, ethylthio), arylthio (for example, phenylthio, p-tolylthio, 2-naphthylthio), amino, including substituted amino (for example, anilino, dimethylamino, diethylamino, morpholino), acyl (for example, formyl, acetyl, benzoyl, benzenesulfonyl), carboalkoxy (for example, carboethoxy, carbomethoxy), or carboxy. Although the azoles used in the practice of this invention can include hetero atoms other than nitrogen in such ring nuclei, those containing nitrogen as the sole hetero atom in the nuclei are most readily available and/or more conveniently prepared. Accordingly, such azoles are preferred for use in toning silver images according to this invention.

Some illustrative L substituents in formula (I), i.e. divalent aliphatic linking groups containing 1 to 8 carbon atoms, often 1 to 3 carbon atoms, include acyclic radicals such as alkylene, for example, methylene, ethylene, propylene, butylene or octylene, fluoroalkylene, such as fluorethylene, divalent acyclic radicals in which a carbon chain is interrupted by a hetero atom such as oxygen and/or sulfur, for example, at least one —O— and/or —S— atom interrupts a carbon chain. The aliphatic linking group is typically hydrocarbon and is unbranched, as exemplified by ethylene and propylene.

Some illustrative T aliphatic terminal groups in formula (I) containing 1 to 10 carbon atoms, typically 4 to 8 and often 6 to 8 carbon atoms include acyclic radicals such as alkyl, for example, methyl, ethyl, propyl, butyl, isobutyl, octyl, nonyl and decyl; fluoroalkyl such as fluoroethyl, dialkylaminoalkyl containing the same or different alkyls such as dimethylaminoethyl or diethylaminoethyl and acyclic radicals in which a carbon chain is interrupted by a hetero atom such as oxygen and/or sulfur, for example, at least one —O— or —S— atom interrupts a carbon chain. Suitable aliphatic terminal groups are typically hydrocarbon groups such as alkyl.

In formula (I) n can be an integer from 1 to 4, but it is most often 1 or 2, and while p can be an integer of 2 to 4, it is most often 2 or 3. Also, while m in formula (I) can be 0 or 1, it is most often 0.

The azoles used in this invention are available in the prior art and/or can be prepared using techniques well known to those skilled in the art. See, for example, U.S. Pat. Nos. 4,720,447; 4,859,565 and 5,006,448, the disclosures of which are hereby incorporated herein by reference. In a typical synthesis, monocyclic azole compounds containing amino and alkylthio substituents can be prepared by alkylating the corresponding mercapto-substituted compounds in the presence of a base. Thus, 3-amino-5-mercapto-1,2,4-triazole can be reacted with an alkyl halide such as the chloride or bromide, in a suitable solvent in the presence of a base such as pyridine or sodium hydroxide. The resulting 3-amino-5-alkylthio-1,2,4-triazole compound can undergo a subsequent reaction with a β-keto ester such as ethyl acetoacetate, preferably under acidic conditions, to yield a 2-alkylthio-4-hydroxy-6-methyl-1,3,3a,7-tetraazaindene compound which, with an appropriate alkyl radical, is also useful as a tone control agent in accordance with the present invention. Such synthetic procedures are well known in the art, as illustrated by previously cited U.S. Pat. No. 4,728,601, where this general type of procedure is described for preparing tetraazaindene compounds containing monothiaalkyl substituents. The disclosure of this patent is hereby incorporated herein by reference.

A suitable procedure for preparing thiaalkylthiomethyl triazole compounds that can be employed in the practice of this invention comprises reacting an N'-formyl-2-chloroacetamidrazone with a thiolate, as described by I. Yanagisawa et al., *J. Med. Chem.*, 1984, Vol. 27, pp. 849-857.

A suitable procedure for preparing polythiaalkyl substituted tetrazole compounds that function as tone control agents in this invention comprises alkylation of thiourea with an alkylthio substituted alkyl halide to yield a thiuronium salt which is reacted with potassium hydroxide, then with a cyano substituted alkyl halide to produce a polythiaalkyl substituted nitrile. The nitrile is then cyclized with sodium azide to yield the tetrazole compound. A suitable method of this type is described in synthesis Example B of U.S. Pat. No. 5,006,448, cited previously herein and incorporated by reference.

The following procedures are typical of those that can be used to prepare azole tone control agents for use in the photographic elements of this invention. The compound numbers appearing in parenthesis in such procedures correspond to those used in Table 1 which is set forth hereinafter, to identify the structure of such compound.

Synthesis of 3-amino-5-{2-[2-(hexylthio)ethylthio]ethylthio}-1,2,4-triazole (Compound 12)

A. Preparation of 2-[2-(hexylthio)ethylthio]ethanol

To a solution of sodium methoxide (5.9 g, 110 mmole) in methanol (200 mL) was added mercaptoethanol (8.91 g, 114 mmole) under a dry nitrogen atmosphere. 2-chloroethyl hexyl sulfide (15.67 g, 103 mmole) was added and the mixture was heated at reflux for two days. The mixture was then cooled, diluted with water, and the organic solvents were removed under vacuum. The residue was diluted with more water and extracted three times with $CH_2Cl_2$. The combined extracts were washed with brine, dried over $MgSO_4$, and concentrated under vacuum to provide a quantitative yield of the above alkylthioethanol compound.

B. Preparation of 2-[2-(hexylthio)ethylthio]ethyl chloride

Dry pyridine (6.8 mL, 84 mmole) was added under a dry nitrogen atmosphere to a chloroform solution (50 mL) of the alkylthioethanol compound (9.4 g, 42 mmole) prepared as described in A above. The mixture was cooled in a salt/ice bath, and p-toluenesulfonyl chloride (12.1 g, 63 mmole) was added. The ice bath was removed, and the mixture was allowed to stand for 2.5 hours, then treated with water (35 mL) and ether (150 mL). The ether portion was separated, washed successively with dilute HCl, saturated aqueous $NaHCO_3$, and brine, dried over $Na_2SO_4$, and concentrated under vacuum. The residue was purified by column chromatography on silica gel to give the above alkylthioethyl chloride compound (4.57 g, 45% yield).

C. Preparation of Compound 12

A mixture of the alkylthioethyl chloride (4.37 g, 20.5 mmole) prepared as described in B above, 3-amino-5-mercapto-1,2,4-triazole (2.64 g, 22.6 mmole), acetonitrile (39 mL), and pyridine (3 mL, 38 mmole) was heated at reflux overnight, cooled, and diluted with $H_2O$ (78 mL). The resulting precipitate was collected by filtration and dried under vacuum to obtain Compound 12 (4.8 g, 79% yield).

Synthesis of 3-amino-5-[2-(hexylthio)ethylthio]-1,2,4-triazole (Compound 6)

Compound 6 was prepared using the procedure used for Compound 12, but with 2-chloroethyl hexyl sulfide as the starting material. The yield was 86%. A portion was recrystallized from ligroin/ethyl acetate to obtain a solid, m.p. 76.5°-78° C. Analysis: Calculated for $C_{10}H_{20}N_4S_2$: C, 46.12; H, 7.74; N, 21.51. Found: C, 46.00; H, 7.56; N, 21.56.

Synthesis of 3-amino-5-[2-(octylthio)ethylthio]-1,2,4-triazole (Compound 7)

Compound 7 was prepared by using the procedure used for Compound 12, but with 2-chloroethyl octyl sulfide as the starting material. The yield was 96%. A portion was recrystallized from ligroin/ethyl acetate to obtain a solid, m.p. 85°-86° C. Analysis: Calculated for $C_{12}H_{24}N_4S_2$: C, 49.96; H, 8.39; N, 19.42. Found: C, 49.54; H, 8.12; N, 19.29.

Synthesis of 3-amino-5-[3-(pentylthio)propylthio]-1,2,4-triazole (Compound 9)

A. Preparation of 3-chloropropyl pentyl sulfide.

A suspension of sodium hydride (4.0 g, 100 mmole) in dry tetrahydrofuran (350 mL) under a nitrogen atmosphere was cooled in an ice bath. Pentyl mercaptan (10.8 g, 100 mmole) was added dropwise over 10 minutes. The resulting suspension of sodium alkylmercaptide was added in portions over 30 minutes to a stirred solution of 1-chloro-3-iodopropane (20.44 g, 100 mmole) in tetrahydrofuran (450 mL) that had been cooled to −78° C. The mixture was allowed to warm to ambient temperature overnight, then washed with brine, dried over $MgSO_4$, and concentrated under vacuum. The resultant oil was distilled under water aspirator pressure to yield the desired product (10.67 g, 59% yield), b.p. 113°-119° C. (20 mm Hg).

B. Preparation of Compound 9.

Compound 9 was prepared from a mixture of 3-chloropropyl pentyl sulfide, 3-amino-5-mercapto-1,2,4-triazole and pyridine in acetonitrile, as described previously for Compound 12. The reaction mixture was poured into water and extracted with $CH_2Cl_2$. The extracts were washed with water and brine, dried over $MgSO_4$, and concentrated under vacuum to provide Compound 9 in 71% yield.

Synthesis of
2-{2-[2-(hexylthio)ethylthio]ethylthio}-4-hydroxy-6-methyl-1,3,3a,7-tetraazaindene (Compound 20).

A mixture of Compound 12 (3.90 g, 13.3 mmole), ethyl acetoacetate (1.94 g, 14.9 mmole), and acetic acid (8.2 mL) was heated at reflux in a dry nitrogen atmosphere overnight. On cooling, the mixture solidified. The solid was collected, washed with cold ethanol and recrystallized from ethanol to yield Compound 20 (4.03 g, 74% yield), m.p. 119°-121° C. Analysis: Calculated for $C_{10}H_{26}N_4OS_3$: C, 49.71; H, 6.78; N, 14.49. Found: C, 48.98; H, 6.76; N, 14.34.

Synthesis of
2-[2-(hexylthio)ethylthio]-4-hydroxy-6-methyl-1,3,3a,7-tetraazaindene (Compound 13)

Compound 13 was prepared from Compound 6, using a procedure analogous to that described previously for Compound 20. The crude product was recrystallized from ethyl acetate to give a white solid, m.p. 125.5°-126° C. Analysis: Calculated for $C_{14}H_{22}N_4OS_2$: C, 51.50; H, 6.79; N, 17.16. Found: C, 50.87; H, 6.62; N, 17.04.

Synthesis of
2-[2-(octylthio)ethylthio]-4-hydroxy-6-methyl-1,3,3a,7-tetraazaindene (Compound 14)

Compound 14 was prepared from Compound 7 using a procedure analogous to that described previously for Compound 20. Recrystallization of the crude product from ethyl acetate gave a 59% yield of a white solid, m.p. 125.5°-127° C. Analysis: Calculated for $C_{16}H_{26}N_4OS_2$: C, 54.21; H, 7.39; N, 15.80. Found: C, 53.51; H, 7.21; N, 15.72.

Synthesis of
2-[3-(pentylthio)propylthio]-4-hydroxy-6-methyl-1,3,3a,7-tetraazaindene (Compound 18)

Compound 18 was prepared from Compound 9, using a procedure analogous to that described previously for Compound 20. The crude product was recrystallized from ethyl acetate to give a 24% yield of white solid, m.p. 121°-123° C. Analysis: Calculated for $C_{14}H_{22}N_4OS_2$: C, 51.50; H, 6.79; N, 17.16. Found: C, 51.30; H, 6.69; N, 16.97.

A partial listing of azoles that can be used as tone-modifying compounds in the practice of this invention are set forth in the following Table I. Such compounds are identified as Compounds 1-21. Table I also contains a list of Comparison Azoles compounds that are identified as Compounds A-I. The latter compounds are structurally similar to azole compounds useful in the practice of this invention and are employed in the following Examples for comparison purposes to illustrate this invention.

TABLE I

Azoles Useful in the Invention

Compound 1

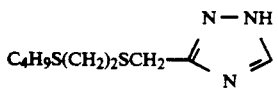

Compound 2

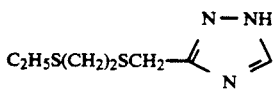

TABLE I-continued

Compound 3

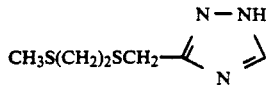

Compound 4

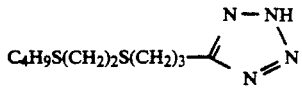

Compound 5

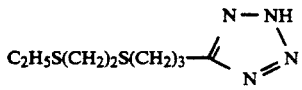

Compound 6

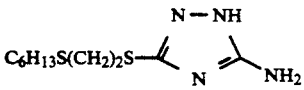

Compound 7

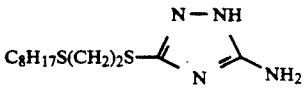

Compound 8

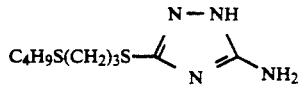

Compound 9

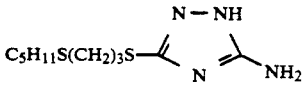

Compound 10

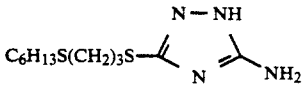

Compound 11

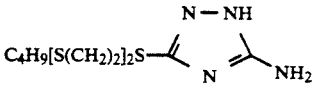

Compound 12

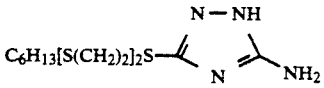

Compound 13

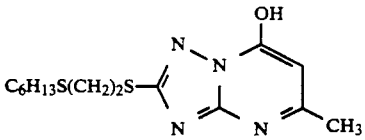

Compound 14

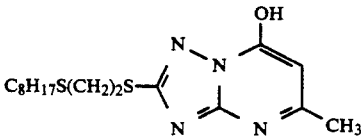

Compound 15

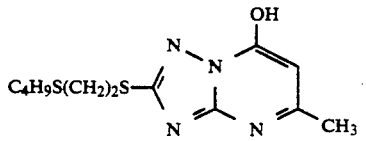

Compound 16

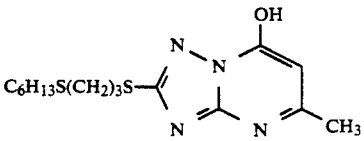

TABLE I-continued

Compound 17

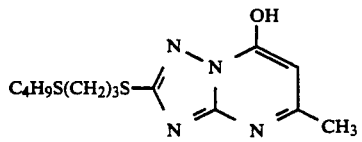

Compound 18

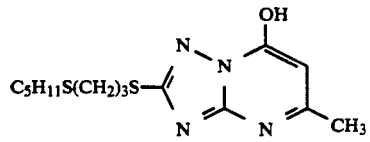

Compound 19

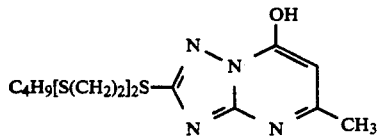

Compound 20

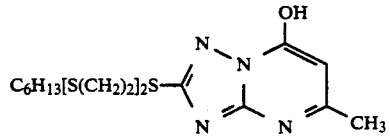

Compound 21

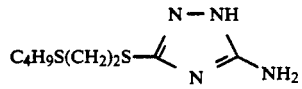

Comparison Azoles

Compound A

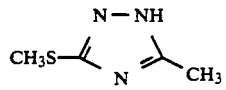

Compound B

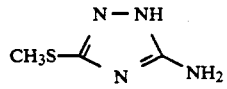

Compound C

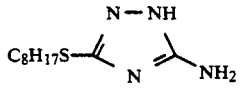

Compound D

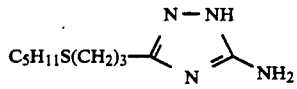

Compound E

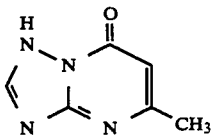

Compound F

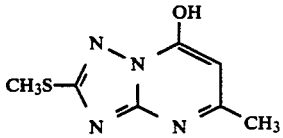

Compound G

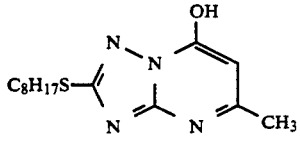

TABLE I-continued

Compound H

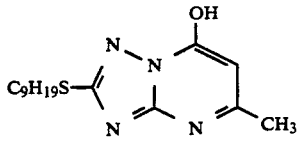

Compound I

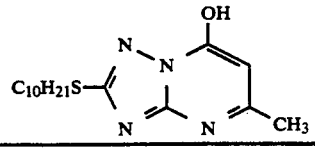

The azole tone-modifying compounds of formula (I) can be used in any concentration effective to modify the tone of a developed silver image according to this invention. As will be recognized by those skilled in the art, the optimum concentration will depend upon several factors, including, for example, the specific radiation sensitive silver halide grains used, the amount of hydrophilic colloid binder or vehicle in the emulsion layer, the layer in which the azole compound is located, the grain size of the silver halide grains and the concentration of silver halide coated. Typically, acceptable tone shifts are achieved with concentrations of the azoles in the range of about 0.2 to 8 grams per mole of silver, although concentrations in the range of about 0.5 to 5, often about 2 to 3 grams per mole of silver are used. Such compounds can be incorporated into the photographic element in various locations using techniques known to those skilled in the art. For example, such compounds may simply be added to an emulsion layer as an aqueous solution or as a solution in an organic solvent such as methanol. Such solutions can also be added to other layers of the photographic element, preferably layers contiguous to the emulsion layer, for example an overcoat or an underlayer. The azoles can be added in any convenient form, for example, they can be added in the form of solid dispersions comprising solid tone modifier, a vehicle such a gelatin and a suitable surfactant. The use of a solid dispersion is particularly effective when it is desired to minimize interaction of the azole tone modifier with other addenda already present in the photographic element. Such addenda include, for example, spectral sensitizing dyes that are absorbed onto the silver halide grain surfaces.

The radiation sensitive silver bromide or bromoiodide emulsion layers as well as other layers such as overcoats, interlayers and subbing layers present in the photographic elements of this invention can comprise various colloids, alone or in combination, as vehicles. Such vehicles provide layers that are permeable to processing solutions and include vehicles such as gelatin, colloidal albumin, cellulose derivatives, synthetic resins such a polyvinyl compounds and acrylamide polymers. A more general selection of suitable hydrophilic colloid vehicles is summarized in *Research Disclosure*, Vol. 308, December 1989, Item 308119, Section IX, Vehicles and Vehicle Extenders, the disclosure of which is hereby incorporated by reference herein, and is contemplated for use in this invention. *Research Disclosure* is published by Kenneth Mason Publications, Ltd., Dudley Annex, 21a North Street, Elmsworth, Hampshire P010 7DQ, England.

As previously indicated herein, the photographic elements of this invention are useful as diagnostic photographic films that are not imagewise exposed with X-radiation, but rather, are exposed with longer wavelength radiation alone. Such films are typically imagewise exposed by means of a laser at a wavelength which can range from the near ultraviolet to the near infrared region of the spectrum (for example, 350 to 1300 nm). When so used, the diagnostic photographic film can, for example, receive image information originally generated by patient exposure to X-radiation and subsequently read from the original recording medium and stored in a computer memory. Computer instructions for digital or analog modulation of the exposing laser coupled with raster scanning of the diagnostic photographic film recreates the original X-radiation image pattern. Such diagnostic photographic films are constructed to be compatible with rapid-access processing, i.e., processing to a viewable silver image in 90 seconds or less. To provide the diagnostic photographic film with a rapid-access processing capability, a hydrophilic vehicle content of less than about 65 mg/dm$^2$, often a level of 20 to 40 mg/dm$^2$ or lower, is used. By reducing the hydrophilic colloid content of a diagnostic photographic film, the amount of liquid that is ingested during processing is limited. It is important that the liquid ingested be limited since this liquid must be removed from the film by drying. Excessive ingestion of liquid leads to increased drying requirements that cannot be met in up to 90 seconds with commercially available rapid-access processing equipment. It is recognized by those skilled in the art that it is not only the total coating density of hydrophilic colloid within a photographic element that controls liquid ingestion, but also the properties of the particular hydrophilic colloid employed. Hydrophilic colloids are chosen for photographic elements because they are processing solution permeable, but it is also important that they not be susceptible to excessive liquid ingestion to meet the aforementioned rapid-access processing requirements. Of course, where the photographic elements of this invention are designed for graphic arts applications, for example, as microfilm or black and white photographic printing paper, more traditional levels of vehicle are employed and conventional black and white processing techniques are used to achieve the desired toned silver images.

The silver image forming photographic elements of this invention comprise a support. A wide variety of suitable supports are known and are commonly employed in the photographic art. Such supports are frequently transparent and when used in diagnostic films, are usually blue tinted to aid in the examination of images. Typical supports are those used in the manufacture of photographic films, including cellulose esters such as cellulose triacetate, cellulose acetate propionate or cellulose acetate butyrate, polyesters such as poly(ethylene terephthalate), polyamides, polycarbonates, polyimides, polyolefins, poly(vinyl acetals), polyethers and polysulfonamides, as well as glass, paper and metal. Supports such as paper that are partially acetylated or coated with baryta and/or a polyolefin, as exemplified by polyethylene and polypropylene, can also be used. Polyester film supports, and especially poly(ethylene terephthalate) supports are preferred because of their excellent dimensional stability characteristics. When such polyester supports are used, a subbing layer is advantageously employed to improve the bonding of hydrophilic colloid containing layers to the support. Useful subbing compositions for this purpose are known in the photographic art and include, for example, polymers of vinylidene chloride such as vinylidene chloride/acrylonitrile/acrylic acid terpolymers or vinylidene chloride/methylacrylates/itaconic acid terpolymers.

The radiation sensitive silver bromide or bromoiodide emulsions used in the emulsion layers described herein can be chemically sensitized, for example with compounds of the sulfur group, noble metal salts such as gold salts, reduction sensitized with reducing agents and combinations of these. Furthermore, emulsion layers and other layers present in the photographic elements of this invention can be hardened with any suitable hardener such as aldehyde hardeners, aziridine hardeners, bis(vinylsulfonylalkyl)ether hardeners, hardeners which are derivatives of dioxane, oxypolysaccharides such as oxy starch, and oxy plant gums. Suitable chemical sensitizers and hardeners are described in *Research Disclosure*, Item 308119, cited previously herein, Section III, Chemical Sensitization, and Section X, Hardeners, the disclosure of which is hereby incorporated herein by reference.

The radiation sensitive silver bromide or silver bromoiodide emulsions used in this invention can also contain additional additives, particularly those known to be beneficial in photographic silver halide emulsions, including for example, stabilizers or antifoggants, speed increasing materials, plasticizers, and spectral sensitizers. Suitable additives of this type are illustrated in *Research Disclosure*, Item 308119, cited previously herein, Section IV, Spectral Sensitization and Desensitization, Section VI, Antifoggants and Stabilizers, and Section XII, Plasticizers and Lubricants, the disclosure of which is hereby incorporated herein by reference.

In addition to the specific features described hereinbefore, the photographic elements of this invention can comprise conventional optional features of the type described in *Research Disclosure*, Item 308119, cited previously herein, and be processed using materials and techniques as described in such *Research Disclosure*, the disclosure of which is hereby incorporated herein by reference.

The following measurement technique and Examples are presented to further illustrate this invention.

In the Examples, the tone of the silver images obtained upon exposure and processing of the photographic elements was evaluated using the following procedure:

The visible transmitted light absorption spectrum was recorded through silver image regions of uniform optical density using a Hitachi Model U-3410 spectrophotometer (commercially available from Hitachi Instruments, Danbury, Conn.). The color for each region was then defined by calculation of the CIE (Commission International de l'Eclairage or International Commission on Illumination) tristimulus values, which combines the energy spectrum of the sample with a given illuminant and the CIE standard color functions. The standard illuminant used was the CIE illuminant $D_{65}$ representing average daylight. CIE LAB values of a* or b* were obtained by mathematical transforms.

The a* values indicate the red-green balance of the silver image while the b* values indicate the yellow-blue balance and are a good indicator of warm or cold image tone. A change of approximately 0.7 in the a* or b* value is generally accepted as the just noticeable difference in color which can be detected by observation with the unaided human eye. Increasingly positive values of b* correspond to increasing warmth (yellowness hue) of the image. A shift toward negative values and increasingly negative values of b* indicate a shift toward or a cold (blue hue) silver image tone. Comparisons of tone for different samples were made at equal optical densities, since the color parameters are density dependent. a* and b* values at an optical density of 1.0 are reported in the tables in the following Examples for the azoles considered.

The azoles used in the samples analyzed are identified in the tables used in the Examples according to the number or letter used to identify such azole in Table 1 set forth hereinbefore.

EXAMPLE 1

Diagnostic photographic films suitable for recording laser images were prepared using a fine cubic grain radiation sensitive silver bromoiodide emulsion. The films were identical except for the inclusion of the azoles indicated in the following Table 2.

In each of the films an emulsion layer was coated on a transparent polyester support at a coverage of 10.8 mg/dm$^2$ silver and 32.2 mg/dm$^2$ gelatin. The emulsion comprised cubic bromoiodide grains containing 3.3 mole percent iodide having a mean ECD of 0.04 μm. The emulsion was chemically sensitized with conventional sulfur and gold sensitizers and spectrally sensitized to red light with a thiacarbocyanine dye. The emulsion layer also contained 4 g/mole of silver of the stabilizer, 5-bromo-4-hydroxy-6-methyl-1,3,3a,7-tetraazaindene, which is not an active tone-modifying agent. A gelatin overcoat, at 7.2 mg/dm$^2$ gelatin was coated over the emulsion layer. The layers were hardened with bis(vinylsulfonylmethyl) ether at 1 percent of the total gelatin weight.

The azoles were coated in the emulsion layer in the form of a solid particle dispersion. Such dispersion was prepared by milling the azole in an aqueous slurry with gelatin and a surfactant. The dispersion contained 3 percent, by weight, azole, 3 percent, by weight, gelatin, and 0.5 percent, by weight, surfactant. The azoles were coated at coverages of from 0.02 to 1.0 mg/dm$^2$.

Samples of the films were exposed with either 365 nm light or spectrally filtered red light to match the spectral sensitizer. Exposed films were processed using a commercial Kodak RP X-Omat (Model 6B) rapid processor as follows:

| | |
|---|---|
| Development | 20 seconds at 40° C. |
| Fixing | 12 seconds at 40° C. |
| Washing | 8 seconds at 40° C. |
| Drying | 20 seconds at 65° C. |

where the remaining time was taken up in transport between processing steps. The development step employed the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |

Water to 1 liter at pH 10.0, and the fixing step employed the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to 4.5 | |

The resulting tone values (a* and b*) and the maximum optical densities (Dmax) measured on the film samples were as follows:

TABLE 2

| Azole | Concentration (g/Ag mole) | a* | b* | Dmax |
|---|---|---|---|---|
| None | — | −5.3 | 15.4 | 1.92 |
| 13 | 5.0 | −3.5 | 11.9 | 2.70 |
| 14 | 5.0 | −3.9 | 12.5 | 2.54 |
| 20 | 1.0 | −4.9 | 10.0 | 2.57 |
| 20 | 2.5 | 1.5 | 2.5 | 2.80 |
| 20 | 5.0 | 2.4 | −1.8 | 2.86 |
| 20 | 7.5 | 1.9 | −1.4 | 2.72 |

From the a* and b* values reported in the above Table 2, it is obvious that the azole compounds employed according to this invention are effective tone-modifying materials. Also, the Dmax values reported in Table 2 illustrate that the azole compounds employed were also effective to increase the covering power of the fine grain radiation sensitive silver bromide emulsions since Dmax increased from 1.92 with no azole to as much as 2.86.

EXAMPLE 2

As previously indicated herein, in this invention, azole compounds having multiple sulfur atoms in the aliphatic substituent on the azole ring are superior tone-modifying compounds in comparison to structurally related azoles, for example, those having only one such sulfur atom or no sulfur substituent on the azole ring. To illustrate this feature of the invention, the effectiveness of several azoles of varying structure were compared as tone-modifying compounds in silver bromide and silver bromoiodide emulsions. The procedure of Example 1 was repeated with three sets of cubic emulsions having the halide compositions indicated in the following Table 3. The azoles were coated in the emulsion layer by adding them in aqueous, basic solutions to the emulsions just prior to coating. The results are reported in the following Table 3.

TABLE 3

| Emulsion ECD (μm) | Emulsion Composition (mole percent) | Azole | Concentration (g/Ag mole) | b* |
|---|---|---|---|---|
| 0.22 | Br(97)I(3) | None | — | 3.1 |
| 0.22 | Br(97)I(3) | E | 3.0 | 3.4 |
| 0.22 | Br(97)I(3) | F | 3.0 | 3.9 |
| 0.22 | Br(97)I(3) | G | 3.0 | 3.4 |
| 0.22 | Br(97)I(3) | 13 | 3.0 | 1.6 |
| 0.22 | Br(97)I(3) | 20 | 3.0 | 1.4 |
| 0.06 | Br(97)I(3) | E | 2.5 | 10.8 |
| 0.06 | Br(97)I(3) | F | 2.5 | 10.3 |
| 0.06 | Br(97)I(3) | G | 2.5 | 10.0 |
| 0.06 | Br(97)I(3) | 13 | 2.5 | 7.3 |
| 0.06 | Br(97)I(3) | 20 | 2.5 | 1.0 |
| 0.22 | Br(100) | None | — | 3.6 |
| 0.22 | Br(100) | E | 3.0 | 4.0 |
| 0.22 | Br(100) | F | 3.0 | 3.3 |
| 0.22 | Br(100) | G | 3.0 | 3.7 |
| 0.22 | Br(100) | H | 3.0 | 3.5 |
| 0.22 | Br(100) | I | 3.0 | 3.5 |
| 0.22 | Br(100) | 13 | 3.0 | 1.3 |

TABLE 3-continued

| Emulsion ECD (μm) | Emulsion Composition (mole percent) | Azole | Concentration (g/Ag mole) | b* |
|---|---|---|---|---|
| 0.22 | Br(100) | 20 | 3.0 | 1.1 |

The results shown in Table 3 demonstrate that azoles containing substituents with multiple sulfur functionalities are clearly superior to those containing none or only a single such sulfur functionality and the latter compounds are essentially inactive as toning agents for radiation sensitive silver bromide and silver bromoiodide emulsion layers according to this invention.

EXAMPLE 3

The preceding Examples 1 and 2 illustrate that certain sulfur containing substituents on a 1,3,3a,7-tetraazaindene ring are very effective silver image tone modifiers in this invention. This Example demonstrates similar activity for related substituents on the aforementioned and other azole ring systems represented by formula (I). The activity for several comparison azoles was also measured.

The procedure of Example 2 was used to evaluate shifts in image tone of developed silver from a radiation sensitive cubic silver bromide emulsion having an ECD of 0.22 μm. The results are reported in the following Table 4.

TABLE 4

| Azole | Concentration (g/Ag mole) | b* |
|---|---|---|
| E | 2.0 | 3.5 |
| G | 2.0 | 3.5 |
| 13 | 0.5 | 1.6 |
| 13 | 2.0 | −2.0 |
| 15 | 0.5 | 0.7 |
| 15 | 2.0 | −1.4 |
| 16 | 0.5 | 1.5 |
| 16 | 2.0 | −2.0 |
| 18 | 0.5 | 0.9 |
| 18 | 2.0 | −2.4 |
| 17 | 0.5 | 1.1 |
| 17 | 2.0 | −1.0 |
| 19 | 0.6 | 0.6 |
| 19 | 1.3 | −1.1 |
| 20 | 0.6 | 3.0 |
| 20 | 1.3 | −0.1 |
| A | 0.5 | 3.5 |
| A | 2.0 | 3.4 |
| 6 | 0.5 | −0.7 |
| 6 | 2.0 | −1.2 |
| 7 | 0.5 | 4.0 |
| 7 | 2.0 | −0.4 |
| 11 | 0.5 | 2.9 |
| 11 | 2.0 | 0.1 |
| 12 | 0.5 | 4.5 |
| 12 | 2.0 | 0.4 |
| 8 | 0.5 | 3.1 |
| 8 | 2.0 | −0.6 |
| 9 | 0.5 | 3.3 |
| 9 | 2.0 | −1.0 |
| 10 | 0.5 | 3.1 |
| 10 | 2.0 | −1.0 |
| B | 0.5 | 3.2 |
| B | 2.0 | 3.4 |
| C | 0.5 | 3.3 |
| C | 2.0 | 1.8 |
| 1 | 0.5 | 1.7 |
| 1 | 2.0 | −0.1 |
| 2 | 0.5 | 0.4 |
| 2 | 2.0 | −1.3 |
| 3 | 0.5 | 0.6 |
| 3 | 2.0 | 0.1 |
| D | 0.5 | 3.2 |
| 4 | 0.5 | −0.4 |

TABLE 4-continued

| Azole | Concentration (g/Ag mole) | b* |
|---|---|---|
| 5 | 0.5 | 1.1 |

The b* values reported in the above Table 4 illustrate that colder silver image tone (particularly negative b* values) is achieved with azole compounds according to this invention while comparison azole compounds that did not have the required sulfur atoms in the substituent groups are ineffective.

EXAMPLE 4

The optimum concentration of an azole that is used to achieve maximum tone shift is typically about 0.5 to 5 g/mole of silver, but this can vary with such factors as the size and halide content of silver halide grains in the emulsion layer and the amount of silver halide coated. To illustrate this feature of the invention, the procedure of Example 1 was repeated using two radiation sensitive cubic grain emulsions of different size and halide composition. The results are reported in the following Table 5.

TABLE 5

| Emulsion ECD (μm) | Emulsion Composition (mole percent) | Azole | Concentration (g/Ag mole) | b* |
|---|---|---|---|---|
| 0.22 | AgBr(100) | 14 | 0.2 | 2.3 |
| 0.22 | AgBr(100) | 14 | 0.5 | 1.7 |
| 0.22 | AgBr(100) | 14 | 1.0 | −1.2 |
| 0.22 | AgBr(100) | 14 | 2.0 | −1.7 |
| 0.22 | AgBr(100) | 14 | 3.0 | −2.1 |
| 0.22 | AgBr(100) | 14 | 5.0 | −2.2 |
| 0.04 | AgBr(97)I(3) | 20 | 0.5 | 11.5 |
| 0.04 | AgBr(97)I(3) | 20 | 1.0 | 9.5 |
| 0.04 | AgBr(97)I(3) | 20 | 2.5 | −1.0 |
| 0.04 | AgBr(97)I(3) | 20 | 5.0 | −2.0 |
| 0.04 | AgBr(97)I(3) | 20 | 7.5 | −1.8 |
| 0.22 | Br(97)I(3) | 13 | 5.0 | −1.3 |
| 0.22 | Br(97)I(3) | 14 | 5.0 | −0.4 |
| 0.22 | Br(97)I(3) | 20 | 2.5 | 0.3 |
| 0.22 | AgBr(100) | 13 | 2.0 | −2.0 |
| 0.22 | AgBr(100) | 14 | 2.0 | −2.1 |
| 0.22 | AgBr(100) | 20 | 1.3 | −0.1 |

EXAMPLE 5

The radiation sensitive grains that are used in the practice of this invention can have various shapes. To illustrate, two radiation sensitive emulsions of comparable grain size were coated using the procedure of Example 1; one emulsion comprised cubic grains while the other comprised octahedral grains. Each emulsion had a mean ECD of 0.13 μm and comprised silver bromoiodide grains (2.5 mole percent iodide).

TABLE 6

| Grain Shape | Azole | Concentration (g/Ag mole) | b* |
|---|---|---|---|
| Cubic | 20 | 0.5 | 6.8 |
| | 20 | 1.0 | 3.9 |
| | 20 | 2.0 | −0.6 |
| Octahedral | 20 | 0.5 | 7.1 |
| | 20 | 1.0 | 3.9 |
| | 20 | 2.0 | −0.1 |

The b* values reported in the above Table 6 show that the range of the tone shift is substantially the same for the cubic and octahedral grain emulsions at the same concentrations of azole. This clearly demonstrates that the invention can be applied to silver halide emulsions in which the silver halide grains have different shapes.

EXAMPLE 6

As previously discussed herein, U.S. Pat. Nos. 4,720,447 and 4,859,565 describe the use of broad classes of azole compounds as density-and/or image tone controlling compounds for silver images formed in DTR processes. In addition to the comparisons set forth in the preceding Examples, we have made several runs which demonstrate that specific azoles disclosed in the aforementioned patents are not effective to modify the tone of the silver image formed from radiation sensitive silver bromide or silver bromoiodide emulsion layers according to this invention. Thus, when the procedure of Example 1 was repeated with cubic silver bromide and silver bromoiodide (3 mole percent iodide) emulsions that had ECDs in the range of 0.7–0.27 using concentrations of 0.2–5 g/mole silver of Compound 36, 2-diethylaminomethylbenzimidazole, of U.S. Pat. No. 4,720,447 and Compound 2, 2-methylthiomethyl-4-hydroxy-6-methyl-1,3,3a,7-tetra-azaindene, of U.S. Pat. No. 4,859,565 there was no significant change in the tone of the silver image obtained.

The invention has been described in detail with particular reference to preferred embodiments thereof, but it will be understood that variations and modifications can be effected within the spirit and scope of the invention.

We claim:

1. A silver image forming photographic element comprised of a support and coated thereon at least one hydrophilic colloid layer including an emulsion layer containing radiation sensitive silver bromide or silver bromoiodide fine grains having a mean equivalent circular diameter of less than 0.3 μm, said element including in said emulsion layer or a hydrophilic colloid layer contiguous to said emulsion layer an azole in a concentration effective to modify the tone of a developed silver image in the emulsion layer, said azole having the formula:

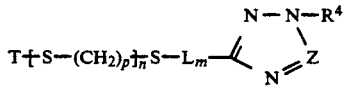

wherein

Z is —N= or —C($R^5$)=;

L is a divalent aliphatic linking group containing 1 to 8 carbon atoms;

T is an aliphatic terminal group containing 1 to 8 carbon atoms;

m is 0 or 1;

n is an integer of 2 to 4;

p is an integer of 2 to 4; and $R^4$ and $R^5$ together complete a 5 or 6 member heterocyclic nucleus containing 1 to 3 ring nitrogen atoms or $R^4$ is hydrogen, an aliphatic group of 1 to 8 carbon atoms or an aromatic group of 1 to 8 carbon atoms and $R^5$ is hydrogen, —$NH_2$, an aliphatic group of 1 to 8 carbon atoms or an aromatic group of up to 8 carbon atoms.

2. The element of claim 1, wherein Z is —C($R^5$)= and $R^4$ and $R^5$ together complete a 6 membered heterocyclic nucleus containing 2 ring nitrogen atoms.

3. A silver image forming photographic element comprised of a support and coated thereon at least one hydrophilic colloid layer including an emulsion layer containing radiation sensitive silver bromide or silver bromoiodide fine grains having a mean equivalent circular diameter of less than 0.3 μm, said element including in said emulsion layer or a hydrophilic colloid layer contiguous to said emulsion layer an azole in a concentration effective to modify the tone of a developed silver image in the emulsion layer, said azole having the formula:

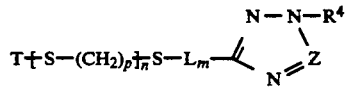

wherein

Z is —N= or —C($R^5$)=;

$R^5$ is hydrogen, —$NH_2$, an aliphatic group of 1 to 8 carbon atoms or an aromatic group of 1 to 8 carbon atoms;

$R^4$ is hydrogen, an aliphatic group of 1 to 8 carbon atoms or an aromatic group of 1 to 8 carbon atoms;

L is a divalent aliphatic linking group containing 1 to 8 carbon atoms;

T is an aliphatic terminal group containing 1 to 8 carbon atoms;

m is 0 or 1;

n is an integer of 1 to 4; and p is an integer of 2 to 4.

4. The element of claim 1 or 3, wherein p is 2.

5. The element of claim 4, wherein m is 0.

6. The element of claim 5, wherein T contains 4 to 8 carbon atoms.

7. The element of claim 1 or 3, wherein the concentration of the azole is in the range of about 0.2 to 8 grams per mole of silver.

8. The element of claim 7, wherein the mean equivalent circular diameter of the fine grains is less than 0.1 μm.

9. The element of claim 7, wherein the fine grains are silver bromide grains.

10. The element of claim 7, wherein the fine grains are silver bromoiodide grains.

11. The element of claim 10, wherein the fine grains are cubic grains.

12. The element of claim 3, wherein Z is —C($R^5$)= where $R^5$ is hydrogen, and $R^4$ is hydrogen.

13. The element of claim 12, wherein p is 2, m is 0 and T contains 4 to 8 carbon atoms.

14. The element of claim 12, wherein the fine grains are silver bromoiodide grains.

15. The element of claim 3 wherein n is 2.

16. A process comprised of developing a photographic element comprised of an emulsion layer containing radiation sensitive silver bromide or silver bromoiodide fine grains having a mean equivalent circular diameter of less than 0.3 μm to produce a silver image of modified tone in the presence of an azole in a concentration effective to modify the tone of the developed silver image, the azole having the formula:

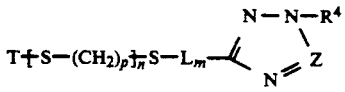

(I)

wherein

Z is —N= or —C($R^5$)=;

L is a divalent aliphatic linking group containing 1 to 8 carbon atoms;

T is an aliphatic terminal group containing 1 to 8 carbon atoms;

m is 0 or 1;

n is an integer of 2 to 4;

p is an integer of 2 to 4; and $R^4$ and $R^5$ together complete a 5 or 6 member heterocyclic nucleus containing 1 to 3 ring nitrogen atoms or $R^4$ is hydrogen, an aliphatic group of 1 to 8 carbon atoms or an aromatic group of 1 to 8 carbon atoms and $R^5$ is hydrogen, —$NH_2$, an aliphatic group of 1 to 8 carbon atoms or an aromatic group of 1 to 8 carbon atoms.

17. A process comprised of developing a photographic element comprised of an emulsion layer containing radiation sensitive silver bromide or silver bromoiodide fine grains having a mean equivalent circular diameter of less than 0.3 μm to produce a silver image of modified tone in the presence of an azole in a concentration effective to modify the tone of the developed silver image, the azole having the formula:

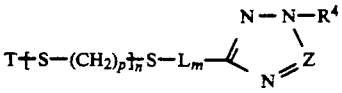

(I)

wherein

Z is —N= or —C($R^5$)=;

$R^5$ is hydrogen, $NH_2$, an aliphatic group of 1 to 8 carbon atoms or an aromatic of 1 to 8 carbon atoms;

$R^4$ is hydrogen, an aliphatic group of 1 to 8 carbon atoms or an aromatic group of 1 to 8 carbon atoms;

L is a divalent aliphatic linking group containing 1 to 8 carbon atoms;

T is an aliphatic terminal group containing 1 to 8 carbon atoms;

m is 0 or 1;

n is an integer of 1 to 4; and p is an integer of 2 to 4.

18. The process of claim 16 or 17, wherein the fine grains are silver bromoiodide grains.

19. The process of claim 18, wherein the silver bromoiodide grains are cubic grains.

20. The process of claim 17 wherein n is 2.

* * * * *